US006986831B2

(12) United States Patent
Ehrola

(10) Patent No.: US 6,986,831 B2
(45) Date of Patent: Jan. 17, 2006

(54) SUCTION ROLL OF A PAPER MACHINE

(75) Inventor: Juha Ehrola, Vaajakoski (FI)

(73) Assignee: Metso Paper, Inc., Helsinki (FI)

( * ) Notice: Subject to any disclaimer, the term of this patent is extended or adjusted under 35 U.S.C. 154(b) by 328 days.

(21) Appl. No.: 10/242,808

(22) Filed: Sep. 13, 2002

(65) Prior Publication Data

US 2003/0051849 A1 Mar. 20, 2003

(30) Foreign Application Priority Data

Sep. 17, 2001 (FI) ..... 20011823

(51) Int. Cl.
*D21F 3/10* (2006.01)

(52) U.S. Cl. ..... 162/368; 162/369; 162/370; 162/371

(58) Field of Classification Search ..... 162/368, 162/369, 370, 371
See application file for complete search history.

(56) References Cited

U.S. PATENT DOCUMENTS 2,964,107 A 12/1960 Walker

FOREIGN PATENT DOCUMENTS

FI 37473 10/1970
GB 736149 9/1955

OTHER PUBLICATIONS

Search Report issued in Finnish Priority Application No. 20011823, d. May 27, 2002.

*Primary Examiner*—Mark Halpern
(74) *Attorney, Agent, or Firm*—Stiennon & Stiennon

(57) ABSTRACT

A paper machine suction roll has a perforated shell (10) and a static suction box (11) sealed against the inner surface of the shell (10) to create a suction zone (11*a*) on the roll surface as it rotates. Holes (14) extending through the shell (10) are placed at distances ($b_1$) of varying magnitude from one another such that the hole pattern formed on the inner surface of the shell (10) is irregular. Each hole (14) has a surrounding countersink situated at regular intervals (a) from one another forming a regular countersink pattern on the outer surface of the shell (10). A conventionally drilled suction roll produces very powerful noise peaks at certain multiples of rotation frequency. When the position of the holes is changed at random in particular in the circumferential direction, regular periodicity disappears and the sound produced is a less disturbing humming-type sound.

10 Claims, 2 Drawing Sheets

SUCTION ROLL OF A PAPER MACHINE

CROSS REFERENCES TO RELATED APPLICATIONS

This application claims priority on Finnish Application No. 20011823, filed Sep. 17, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a suction roll of a paper machine comprising a perforated shell and a static suction box sealed against the inner surface of the shell to create a suction zone on the surface of the suction roll while the shell rotates.

Suction rolls provided with a suction box are used particularly in the forming section and the press section of paper and board machines at locations where a high local vacuum is needed. The suction box sealed against the inner surface of the roll shell is connected to a vacuum system, whereby a local vacuum of desired magnitude and, as a result of it, a flow of water or air into the suction roll are produced in that sector of the shell which is at the suction box each time when the roll is rotating. The holes drilled through the shell are generally provided with countersinks, or counterbores, in the outer surface of the shell, the function of which countersinks is to reduce the size of unbroken connecting portions in the outer surface of the shell and to enlarge the open area of the outer surface. In the suction rolls of prior art, the countersink surrounds the suction hole symmetrically. Both the countersink pattern and the bore pattern are generally regular, which is important in order to provide an even suction effect and to prevent marking of the web.

One considerable problem associated with suction rolls is the noise they generate. At the end of the suction zone, a vacuum prevails in the individual holes of the shell, which vacuum is filled with air suddenly and noisily after the seal of the trailing side. As the roll comprises thousands of holes and the phenomenon is repeated in rapid succession, the ear distinguishes only a continuous tune, whose pitch depends on the speed of the roll and on the length of the regular drill pattern. Noise peaks can additionally occur at certain multiples of rotation frequency. If the holes are in axial rows, an entire row produces simultaneously a sound impulse, with the result that the noise which is produced may become intolerable at high speeds. By arranging the drill pattern of the holes to be spiral-like, the number of the holes filled simultaneously can be made smaller at the same time as their spacing is reduced, whereby the volume of sound decreases. However, in many cases this is not sufficient to attenuate the noise to an acceptable level.

The aim of the invention is to reduce the noise caused by suction rolls.

SUMMARY OF THE INVENTION

The suction roll according to the invention is characterized in that the holes of the shell are situated at distances of varying magnitude from one another such that the hole pattern formed on the inner surface of the shell is irregular.

A suction roll which has been drilled in a traditional manner produces very powerful noise peaks at certain multiples of rotation frequency. When the position of the holes is changed at random in particular in the circumferential direction, regular periodicity disappears and the sound turns into a humming-type sound, thus being less disturbing.

BRIEF DESCRIPTION OF THE DRAWINGS

In the following, the invention will be described in greater detail with reference to the figures in the appended drawings, but the invention is not meant to be strictly limited to the details of the figures.

DESCRIPTION OF THE PREFERRED EMBODIMENTS

Figure 1:
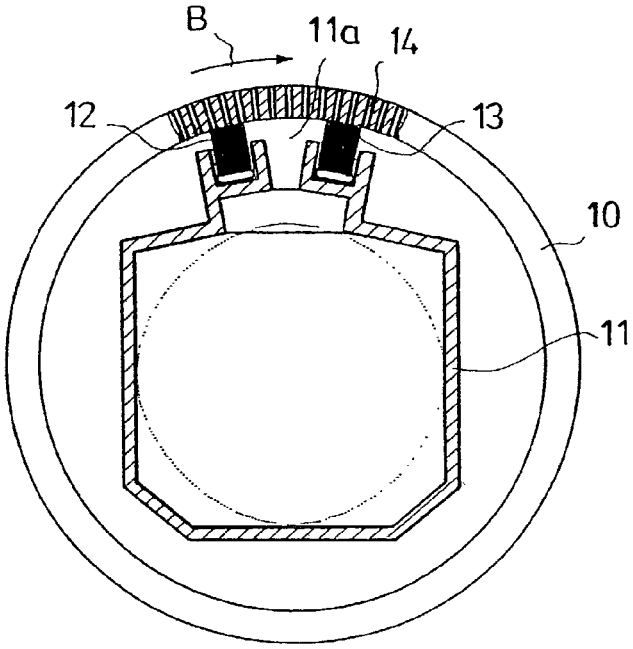
FIG. 1 is a cross-sectional view of a suction roll provided with a suction box.

The suction roll shown in FIG. 1 comprises a perforated shell 10, which is arranged to rotate around a roll shaft in the direction of the arrow B. A static suction box 11 is placed inside the shell 10, which suction box is connected to a vacuum source (not shown). The suction box 11 is sealed against the inner surface of the shell 10 by means of sealing strips 12 and 13, whereby a suction zone 11*a* acting in the area remaining between the seals 12, 13 is formed in the surface of the roll. In the suction rolls in accordance with the state of the art, holes 14 extending through the shell have been drilled at regular intervals from one another such that they form a spiral-shaped drill pattern on the surface of the roll. In the area of the suction zone 11*a*, a vacuum produced by the suction box 11 prevails in the holes 14. After the seal 13 of the trailing side, air penetrates into the holes 14 through the interior of the roll, in which connection a powerful popping or whistling sound is produced in the holes 14. When a large number of holes 14 is filled with air simultaneously over the entire length of the roll, the sound is multiplied. At certain multiples of rotation frequency, the sounds are further strengthened and particularly powerful noise peaks are created.

Figure 2:
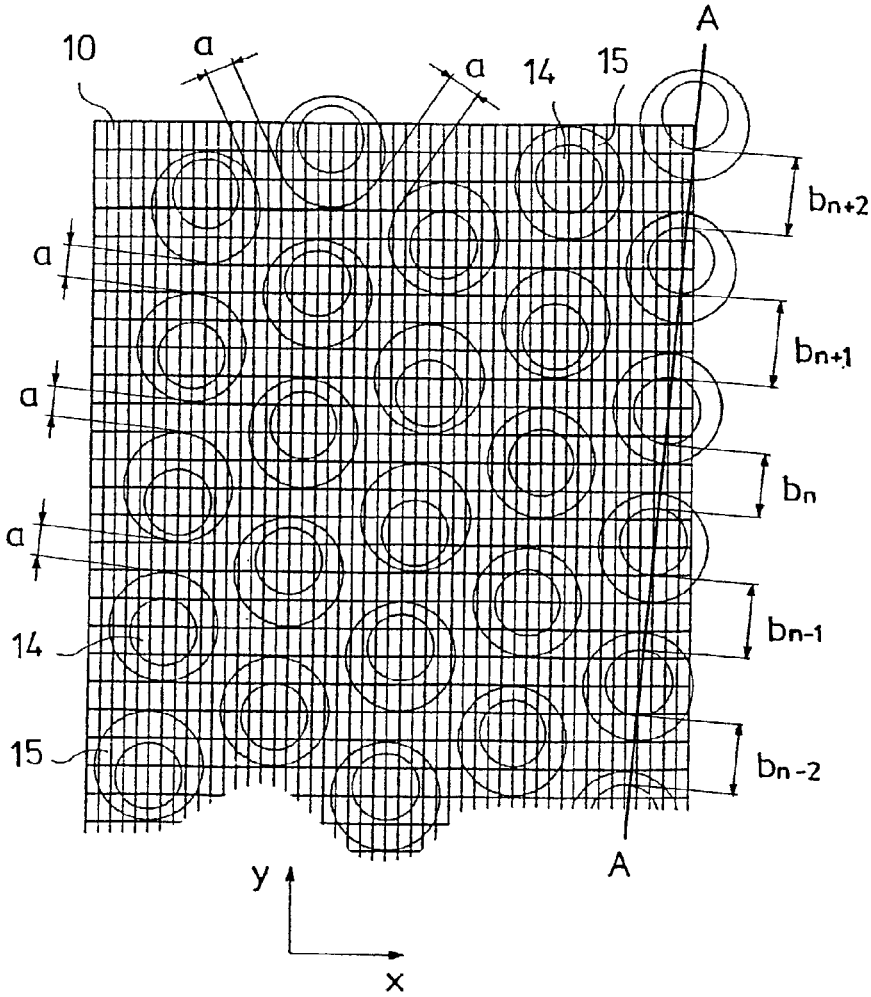
FIG. 2 shows hole patterning of a suction roll in accordance with the invention as viewed from the direction of the surface of the roll.

FIG. 2 shows, as spread out, a portion of the surface pattern of a suction roll in accordance with the invention, which pattern is formed of holes 14 extending through a shell 10 and of countersinks 15 surrounding the holes (the background grid illustrates the position of the holes 14 and the countersinks 15 with respect to one another). The countersinks 15 have been drilled at regular intervals a from one another such that there is an equal distance a from the circumference of each countersink 15 to the outer edge of six countersinks 15 closest to it. The pattern formed by the countersinks 15 may naturally also be different from the regular hexagon shown in FIG. 2. A curved line A—A curving rectilinearly along the outer surface of the roll can be drawn through the centers of the countersinks 15, the angle of inclination of the curved line differing to some extent from the circumferential direction y perpendicular to the axial direction x of the roll. The holes 14 extending through the shell 10 have been placed at random such that each hole 14 is inside the countersink 15, but the centers of the hole 14 and the countersink 15 surrounding it do not generally coincide. It follows that the distances $b_i$ between successive holes 14 are of varying magnitude within the limits allowed by the countersinks 15 situated at regular intervals a from one another. This has been illustrated in FIG. 2 by showing some of the distances $b_{n-2}$, $b_{n-1}$, $b_n$, $b_{n+1}$, $b_{n+2}$ between the holes 14 in the direction of the curved line A—A, which distances are unequal in magnitude as compared with one another.

Figure 3:
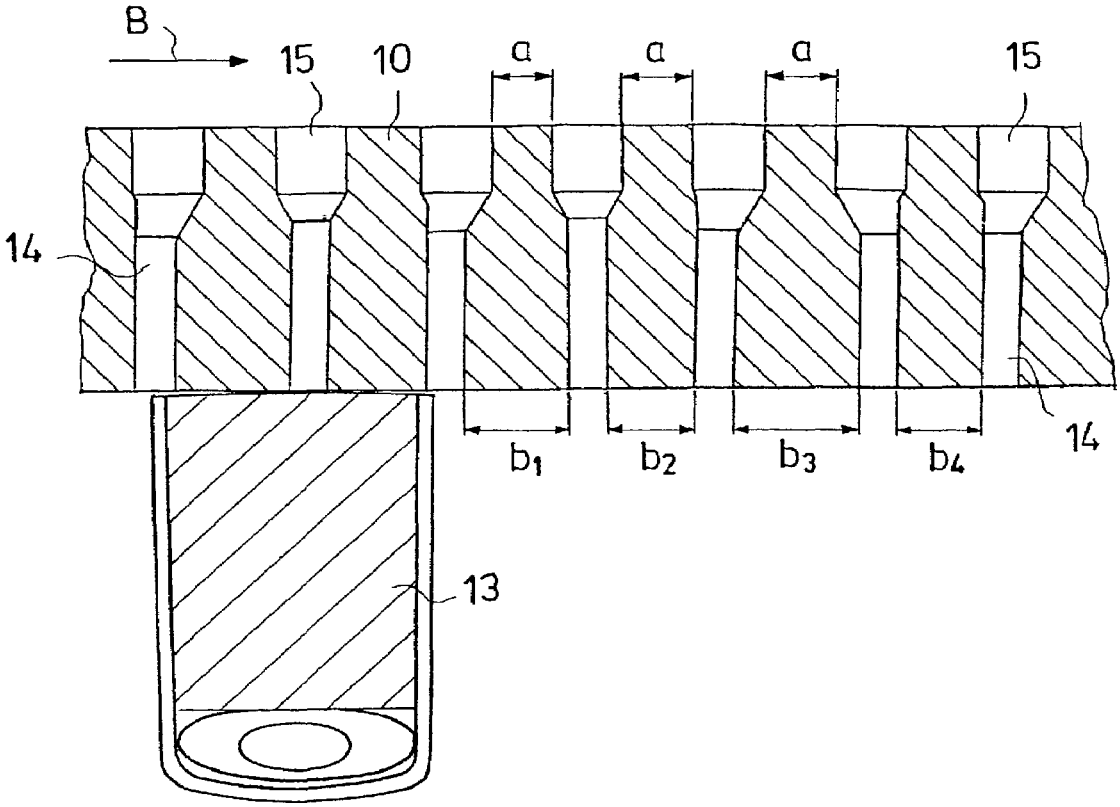
FIG. 3 is a cross-sectional view of the structure of the suction roll shell in the thickness direction taken along the line A—A shown in FIG. 2.

FIG. 3 shows a portion of the curved surface of the shell 10 of the suction roll—for the sake of simplicity, as straightened and in a cross-sectional view taken along the curved line A—A shown in FIG. 2, in which connection the centers of the holes 14 placed in succession in the circumferential direction of the roll are situated on the same line A—A but at varying distances $b_i$ from one another. The figure also shows a sealing strip 13 on the trailing side of the suction box, the holes 14 being filled with air after they pass the sealing strip. The distance a between two successive countersinks 15 drilled into the outer surface of the shell 10 is constant, but the distances $b_1$, $b_2$, $b_3$, $b_4$ remaining between successive holes 14 extending through the shell 10 are unequal in magnitude as compared with one another.

When there is regular irregularity like that shown in FIGS. 2 and 3 over the entire length of the roll in each hole row parallel to the curved line A—A, the number of the holes 14 which come simultaneously to the trailing side of the sealing strip 13 is smaller than in the conventional suction roll having a regular hole pattern. When the holes in adjacent rows A—A are filled after the sealing strip 13 at a different pace, the noise that is produced is more of the humming type than in the suction rolls of the present type, and thus noise peaks are avoided.

When the countersink pattern in the surface of the shell is regular and the pattern formed by the holes extending through the shell is irregular, the noise level caused by the roll can be substantially lowered without losing the even suction effect of the suction zone of the roll at the same time and without increasing the tendency to marking.

I claim:

1. A suction roll of a paper machine comprising:

a perforated shell having an inner surface and an outer surface, and portions of the shell which define a plurality of through holes extending through the shell between the inner surface and the outer surface, each through hole having a second center; and a static suction box sealed against the inner surface of the shell to create a suction zone on the outer surface of the suction roll while the shell rotates, wherein the holes of the shell are situated at distances of varying magnitude from one another such that the hole pattern formed on the inner surface of the shell is irregular, wherein an axial direction is defined which is parallel to an axis of the roll, and wherein a circumferential direction is defined which is perpendicular to the axial direction and extending along the surface of the roll, and wherein a curved line is defined which extends along the surface of the roll having an angle greater than zero with respect to the circumferential direction, and wherein a plurality of first centers of first circles of a diameter greater than the through hole diameter are defined extending in a spiral pattern wrapping around the roll, each of said first centers being positioned on said curved line, and wherein the spacing between the first centers along said curved line is equal, and wherein each of said plurality of through holes has a second center, the second centers being positioned within one of the first circles, the distances between successive through holes measured along said curved line being of varying magnitude and the first circles are of uniform diameter.

2. The suction roll of claim 1 wherein a countersink surrounds each hole in the outer surface of the shell, which countersinks are situated at regular intervals from one another forming a regular countersink pattern on the outer surface of the shell.

3. The suction roll of claim 1 wherein the shell has a circumferential direction extending around the outer surface, and an axial direction extending parallel to an axis of the shell, and wherein the variation of the distances between the holes is higher in the circumferential direction of the roll shell than in the axial direction of the roll shell.

4. The suction roll of claim 3, wherein the angle of inclination of the curved line differs only slightly from the circumferential direction of the roll, and wherein, in the axial direction of the roll, the distance between successive curved lines is substantially constant, while the distances between the holes situated in succession on a single curved line vary at random.

5. A paper machine suction roll comprising:

a perforated cylindrical shell having an inner surface and an outer surface, and portions of the shell which define a plurality of holes which extend through the shell from the inner surface to the outer surface, wherein each hole comprises a countersink of a first diameter with a first center which extends inwardly from the outer surface and a through opening of a second diameter with a second center which extends inwardly from the countersink to the inner surface, wherein the second diameter is less than the first diameter; and a static suction box sealed against the inner surface of the shell to create a suction zone on the outer surface of the suction roll while the shell rotates, wherein the countersinks are situated at regular intervals from one another forming a regular countersink pattern on the outer surface of the shell, and wherein the through openings of a second diameter are situated at distances of varying magnitude from one another, with a plurality of the through opening second centers offset from the first centers of the countersinks of the holes of which they form a part such that the hole pattern formed on the inner surface of the shell is irregular.

6. The paper machine suction roll of claim 5 wherein a curved line extending rectilinearly along the circumference of the shell can be drawn through the second centers, the curved line having an angle of inclination with respect to a circumferential direction of the shell which is greater than zero, wherein in the axial direction of the shell, the distance between successive curved lines is substantially constant, while the distances between the second centers in succession on a single curved line vary at random.

7. The paper machine suction roll of claim 6 wherein the distances between successive first centers on a single curved line are substantially constant.

8. The suction roll of claim 5 wherein the shell has a circumferential direction extending around the outer surface, and an axial direction extending parallel to an axis of the shell, and wherein the variation of the distances between the second diameter openings is higher in the circumferential direction of the roll shell than in the axial direction of the roll shell.

9. A suction roll of a paper machine comprising:

a perforated shell having an inner surface and an outer surface, and a plurality of second holes extending through the shell between the inner surface and the outer surface, the shell having an axis, and an axial direction defined parallel to the axis;

a static suction box sealed against the inner surface of the shell to create a suction zone on the outer surface of the suction roll while the shell rotates, the suction box having a trailing sealing strip which engages the shell inner surface and which bas a trailing side edge which extends in the axial direction;

wherein a circumferential direction is defined which is perpendicular to the axial direction and extending along the surface of the roll;

wherein a plurality of first circles having first centers are defined extending in a spiral pattern wrapping around the roll, and wherein a curved line can be drawn which extends along the surface of the roll having an angle greater than zero with respect to the circumferential direction, and wherein each of said first centers is positioned on said curved line; and wherein the spacing between the first centers along said curved line is equal; and wherein each of said plurality of second holes has a second center, the second centers being situated on said curved line at varying distances from one another, such that the distances between successive holes are unequal in magnitude as compared with one another; and wherein the first circles centered on the first centers have the same diameter as the second holes centered on the second centers, such that the number of the second holes which come simultaneously to the trailing side edge of the sealing strip is smaller than the number of first circles which come simultaneously to the trailing side edge of the sealing strip.

10. A paper machine suction roll comprising:

a perforated cylindrical shell having an inner surface and an outer surface, and a plurality of holes which extend through the shell from the inner surface to the outer surface, wherein each hole comprises a countersink of a first diameter and having a first center which extends inwardly from the outer surface and a through opening of a second diameter which extends inwardly from the countersink to the inner surface, and which has a second center, wherein the second diameter is less than the first diameter; and a static suction box sealed against the inner surface of the shell to create a suction zone on the outer surface of the suction roll while the shell rotates, wherein an axial direction is defined which is parallel to the axis of the roll, and wherein a circumferential direction is defined which is perpendicular to the axial direction and extending along the surface of the roll, and wherein the countersink first centers extend in a spiral pattern wrapping around the roll, wherein a curved line can be drawn which extends along the surface of the roll having an angle greater than zero with respect to the circumferential direction and which extends through each of said first centers; and wherein the spacing between subsequent first centers along the curved line is equal, and wherein each of the second centers of the through openings is irregularly spaced along said curved line, such that the distance between a first through opening and a second through opening positioned along the curved line without any intervening through opening, is different than the distance between said second through opening and a third through opening positioned along the curved line after said second through opening without any intervening second diameter opening.

* * * * *